US009867749B2

(12) United States Patent
Mitchell

(10) Patent No.: US 9,867,749 B2
(45) Date of Patent: Jan. 16, 2018

(54) FACIAL CRADLE

(71) Applicant: Matthew Mitchell, Wichita, KS (US)

(72) Inventor: Matthew Mitchell, Wichita, KS (US)

( * ) Notice: Subject to any disclaimer, the term of this patent is extended or adjusted under 35 U.S.C. 154(b) by 258 days.

(21) Appl. No.: 14/714,622

(22) Filed: May 18, 2015

(65) Prior Publication Data

US 2015/0245968 A1 Sep. 3, 2015

(51) Int. Cl.

| | |
|---|---|
| ***A47C 20/00*** | (2006.01) |
| ***A61G 7/07*** | (2006.01) |
| ***A61G 13/12*** | (2006.01) |
| ***A61H 39/04*** | (2006.01) |

(52) U.S. Cl.

CPC ..... *A61G 7/072* (2013.01); *A61G 13/121* (2013.01); *A61H 39/04* (2013.01); *A61G 2200/325* (2013.01); *A61H 2201/1604* (2013.01); *A61H 2203/0468* (2013.01); *A61H 2205/02* (2013.01); *A61H 2205/025* (2013.01)

(58) Field of Classification Search

CPC ..... A61G 7/072; A61G 13/121; A61G 2200/325; A61H 39/04; A61H 2201/1604; A61H 2203/0468; A61H 2205/02; A61H 2205/025

See application file for complete search history.

(56) References Cited

U.S. PATENT DOCUMENTS

D277,059 S 1/1985 Boone
4,504,050 A * 3/1985 Osborne ..... A61G 13/12 378/179
4,752,064 A * 6/1988 Voss ..... A61G 13/12 5/622
D298,992 S 12/1988 Voss
4,920,956 A 5/1990 Yamauchi
5,165,137 A * 11/1992 Amrein ..... A61G 13/121 403/43
5,257,429 A 11/1993 Genis
5,427,436 A 6/1995 Lloyd
5,652,981 A * 8/1997 Singer-Leyton ..... A47C 20/025 5/631
5,678,894 A * 10/1997 Eley ..... A61G 15/02 297/354.13
5,865,505 A 2/1999 Eley
5,960,494 A 10/1999 Gilliland et al.
6,151,734 A * 11/2000 Lawrie ..... A47C 20/026 5/622
D456,516 S 4/2002 Cheshaek et al.
6,374,441 B1 4/2002 Begell
D473,413 S 4/2003 Huang
(Continued)

*Primary Examiner* — David E Sosnowski
(74) *Attorney, Agent, or Firm* — Kenneth H. Jack; Davis & Jack, L.L.C.

(57) ABSTRACT

A cradle for facial support of a prone patient's head, the patient's head having a glabellar acupressure point between his or her eyes, the cradle including an "E" cushion having upper and lower ends, and having left, right, and medial arms, each arm among the left, right, and medial arms having proximal and distal ends; the "E" cushion's medial arm being adapted for, upon the facial support of the patient's head, impinging against his or her glabellar acupressure point; the cradle further incorporating a rigid base fixedly attached to the "E" cushion's lower end and "velcro" pads for releasably mounting the "E" cushion upon the support bracket arms of an examination table.

7 Claims, 4 Drawing Sheets

(56) References Cited

U.S. PATENT DOCUMENTS 6,671,907 B1* 1/2004 Zuberi ..... A47G 9/1063 128/845
6,842,924 B1* 1/2005 Walters ..... A47C 20/026 5/636
7,089,613 B2 8/2006 Cohen
7,225,485 B2 6/2007 Binder
D555,251 S 11/2007 Riach
7,424,759 B2 9/2008 Damron
7,574,759 B2 8/2009 Wilson et al.
7,676,867 B2 3/2010 DeLaura
D625,420 S 10/2010 Sharps et al.
D665,912 S 4/2012 Skripps
8,161,588 B1* 4/2012 Anson ..... A47G 9/109 5/630
8,360,066 B2 1/2013 Piontek
8,365,329 B1* 2/2013 Barsosky ..... A47D 13/083 5/632
2005/0109346 A1* 5/2005 Cohen ..... A47C 20/026 128/845
2006/0053557 A1* 3/2006 Damron ..... A61G 13/121 5/640
2006/0150336 A1 7/2006 Jackson, III
2007/0056108 A1 3/2007 Nikolopoulos
2008/0005841 A1* 1/2008 Zelnik ..... A47C 20/026 5/601
2009/0307846 A1* 12/2009 Eura ..... A47C 7/383 5/636
2012/0278993 A1* 11/2012 Gard ..... A47C 20/026 5/640
2013/0007961 A1* 1/2013 Noh ..... A61H 39/04 5/638
2013/0086749 A1* 4/2013 Crompton ..... A47G 9/1054 5/638
2013/0205504 A1* 8/2013 Ratner ..... A61G 13/121 5/622
2013/0245395 A1* 9/2013 Bidarian Moniri .. A47C 20/026 600/301
2015/0000041 A1* 1/2015 Riach ..... A47C 20/026 5/652
2015/0223622 A1* 8/2015 Mobley ..... A47G 9/1054 5/638
2015/0245967 A1* 9/2015 Horng ..... A47G 9/1081 128/845
2015/0245968 A1* 9/2015 Mitchell ..... A61G 7/072 5/638
2016/0120725 A1* 5/2016 Slattery ..... A61G 13/121 5/622

* cited by examiner

FACIAL CRADLE

FIELD OF THE INVENTION

This invention relates to facial support cradles which are adapted for facilitation of prone positioning and support of patients or subjects upon medical examination tables, physical therapy tables, and massage tables.

BACKGROUND OF THE INVENTION

Persons undergoing medical treatment, physical therapy, chiropractic treatment, or massage therapy often lie in a prone or face down position upon a padded table or bench, such table having a head end which is equipped with a facial cradle. During a subject's prone positioned use of such table and facial cradle combination, the subject typically places his or her face directly against upper cushioned surfaces of the facial cradle, the subject viewing therethrough downwardly. Such patients or subjects who lie prone upon such tables often experience anxiety and stress resulting from performance of medical examinations, physical therapy, or chiropractic procedures and manipulations. During prone body positioning, such procedures are typically performed outside of the view of the patient or subject, resulting in stress and anxiety. Conventionally designed and configured table mounted facial cradles tend to aggravate or exacerbate such anxiety and stress by enclosing the subject's face and by acting as blinders which restrict the subject's view to the floor and block peripheral vision.

The instant inventive facial cradle solves or ameliorates the above drawbacks and deficiencies of conventionally configured facial cradles by incorporating specially configured structures which mechanically exert upward contact and pressure against a subject user's facial glabellar point.

BRIEF SUMMARY OF THE INVENTION

Human facial anatomy includes a glabella or glabellar point which is located at the intersection of a subject's sagittal plane and a transverse plane situated at the subject's left and right cranial supra-orbital processes. Anatomy underlying the facial glabellar point comprises the cranium's glabellar suture which is situated immediately posterior to the cranial frontal suture and immediately anterior to the internasal suture. Procerus muscles overlie the cranial glabellar suture, and one or more sub-branches of the ophthalmic branch of the trigeminal nerve typically underlie the glabellar point.

Light percussive contact or tapping exerted against a subject's facial glabellar point is known in the medical arts to produce a glabellar reflex which consists of involuntary closure of eyes. In the acupressure arts, light massaging pressure applied to a subject's glabellar point is understood to effect a lessening of anxiety and to induce relaxation and a state of calm. The instant inventive facial cradle advantageously produces similar contact with and pressure against a patient or subject's facial glabellar point while simultaneously providing face and head support. A cushion component performs such dual head support and glabellar contact functions by providing a laterally extending column section which figuratively corresponds with the column portion of a "E", and by providing left, right, and medial arms, each such arm having a proximal end fixedly attached to or formed wholly with the E's column section. Distal ends of the "E" cushion's left and right arms perform the facial support function while the "E" cushion's medial arm performs the glabellar point contacting function.

In a preferred embodiment, the "E" cushion's medial or center arm is configured as a "V" having a length or posterior extension which aligns the vertex of the "V" for contact with a patient's glabellar point while anterior aspects of the "E" cushion's column section comfortably support the patient's forehead.

In a preferred embodiment, the "E" cushion of the instant invention is attached to and is supported upon an examination or therapy table in a manner common to conventional facial cradles. In use of the instant inventive facial cradle, a patient or subject may rest his or her face and head against the cushioned upper surfaces of the facial cradle in a manner similar to conventional usage of facial cradles. Simultaneously with resultant face and head support, the inventive "E" cushion's medial arm contacts and presses upwardly against the subject's facial glabellar point advantageously inducing, in the manner of acupressure therapy, a state of calm and lessened anxiety.

Accordingly, objects of the instant invention include the provision of a facial cradle which incorporates structures as described above, and which arranges those structures in relation to each other in manners described above for achievement of the beneficial functions described above.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figure 1:
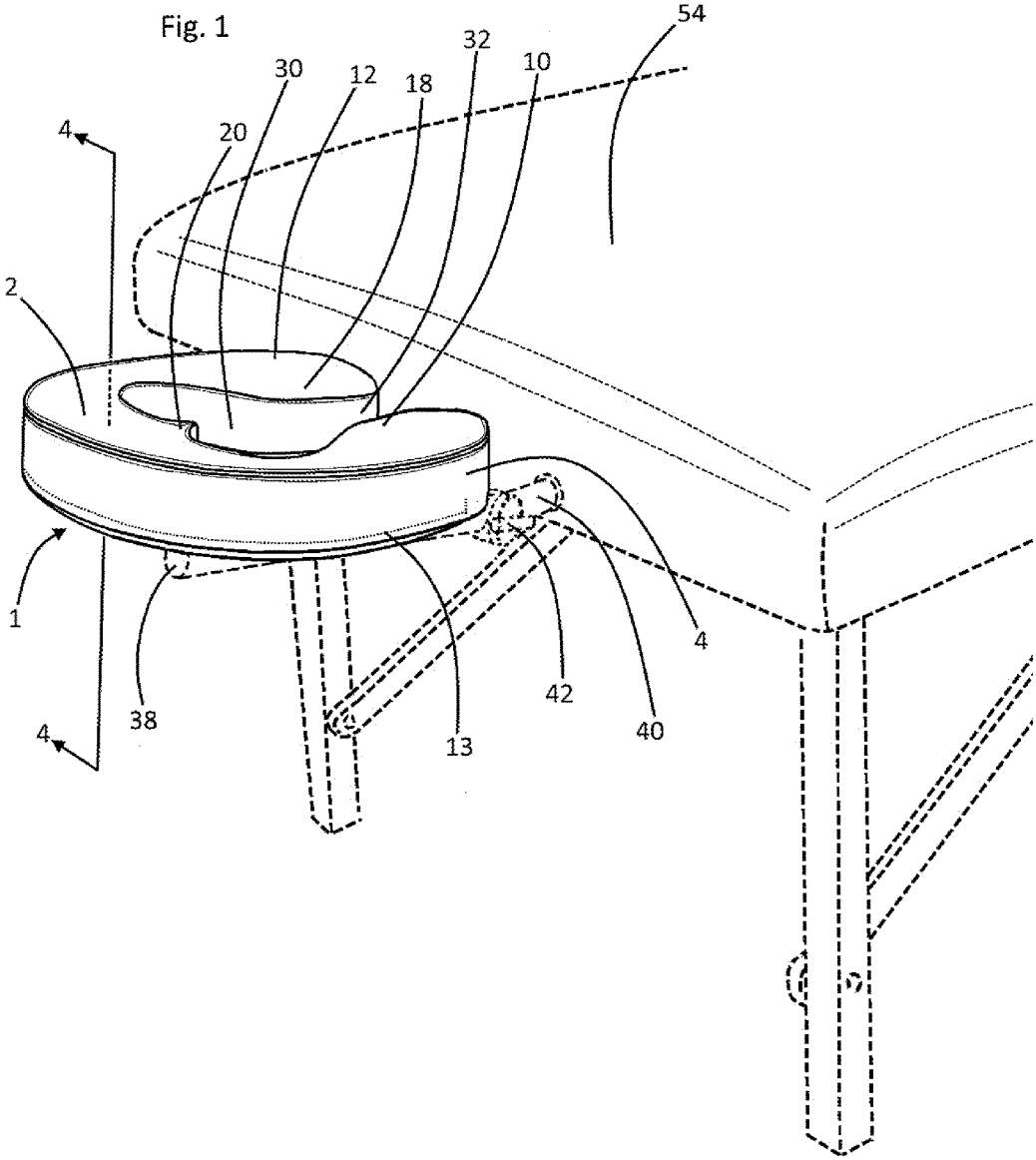
FIG. 1 is a perspective view of the instant inventive facial cradle, the view further showing in dashed lines and associated examining table or therapy table.

Referring now to the drawings, and in particular to FIG. 1, a preferred embodiment of the instant inventive facial cradle is referred to generally by Reference Arrow 1. A primary structural component of the facial cradle 1 comprises an "E" cushion which, similarly with a commonly formed capital letter "E", includes a column section 2, a left arm (or lower arm from the perspective of an upright letter "E") 4, a right arm (or upper arm from perspective of the upright letter "E") 12, and a medial arm 20.

Figure 2:
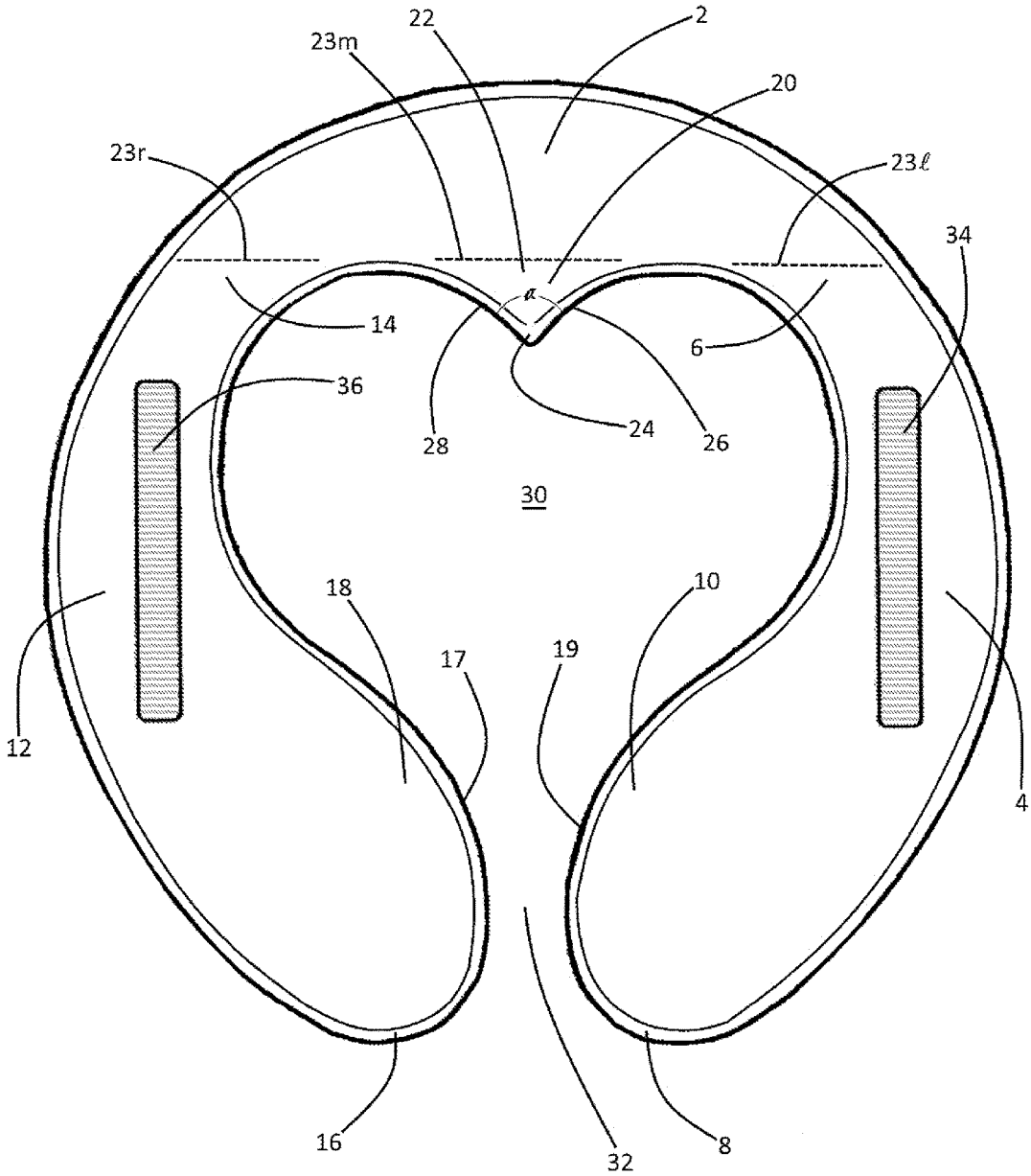
FIG. 2 is an undersurface view of the facial cradle depicted in FIG. 1.

Referring simultaneously to FIGS. 1 and 2, the "E" cushion's left, right, and medial arms 4, 12, and 20 respectively have proximal and distal ends 6 and 8, 14 and 16, and 22 and 24. Such arms' proximal ends 6, 14, and 22 are preferably fixedly attached to or formed wholly with a distal or posterior aspect of the "E" cushion's laterally extending column section 2. Laterally extending dashed lines 23*l*, 23*r*, and 23*m* appearing upon FIG. 2 are respectively situated at the proximal-most ends of the left, right, and medial arms 4, 12, and 20, such lines being representative of the arm's attachments to or whole formations with column 2.

Referring to FIG. 2, the "E" cushion's medial arm 20 preferably is configured to include left and right walls 26 and 28, such walls forming a "V". The distal-most or posterior ends of the walls 26 and 28 preferably form a vertex 24 whose upper end advantageously functions, as is further explained below, as a glabellar point contacting member. Angle α between such "V" configured walls 26 and 28 is preferably approximately 90°. Suitably, such angle α may alternatively be as acute as a 75° angle, or as obtuse as a 105° angle.

Figure 3:
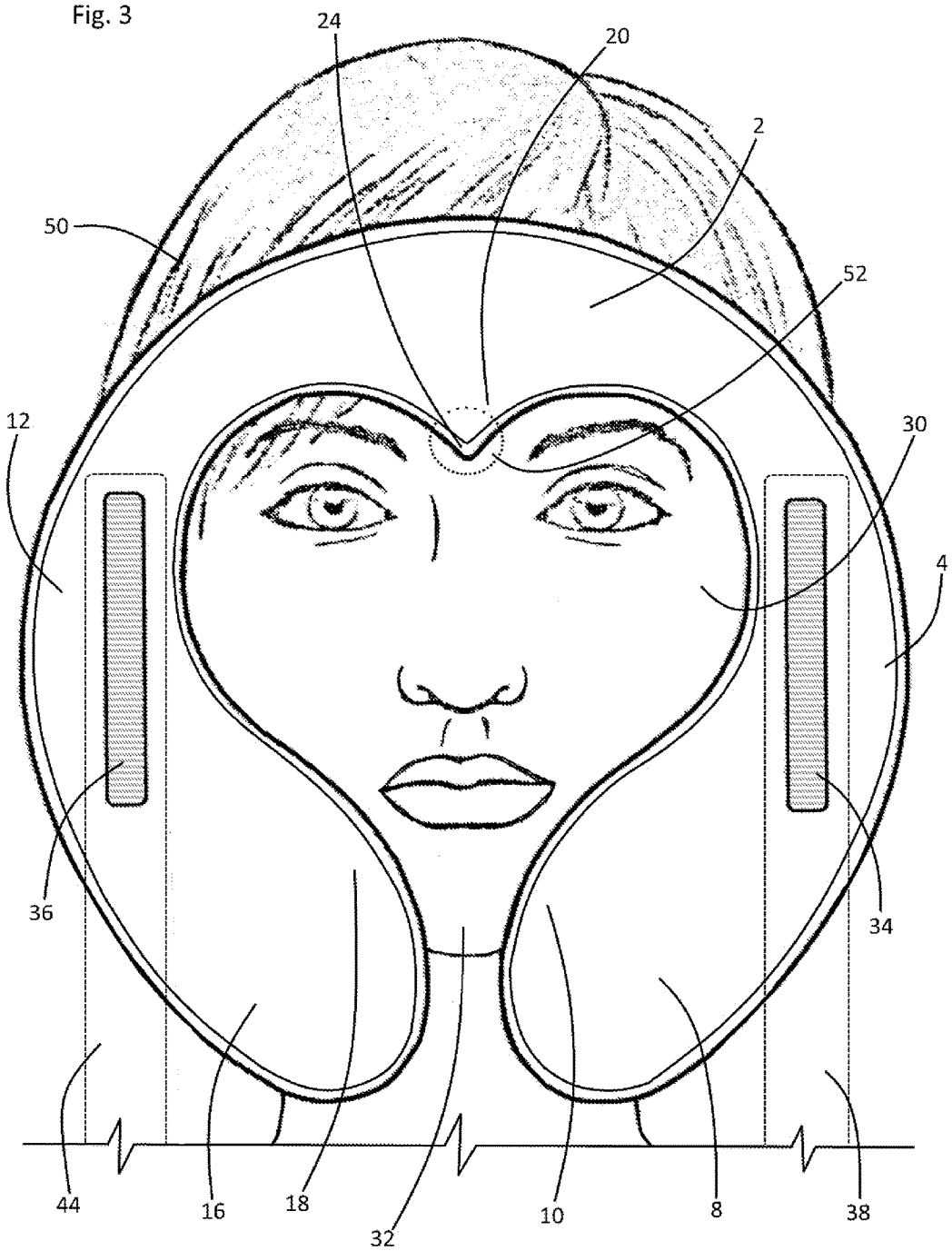
FIG. 3 redepicts the structure of FIG. 2, the view of FIG. 3 further showing an overlying and supported face and head of a patient or subject.
Figure 4:
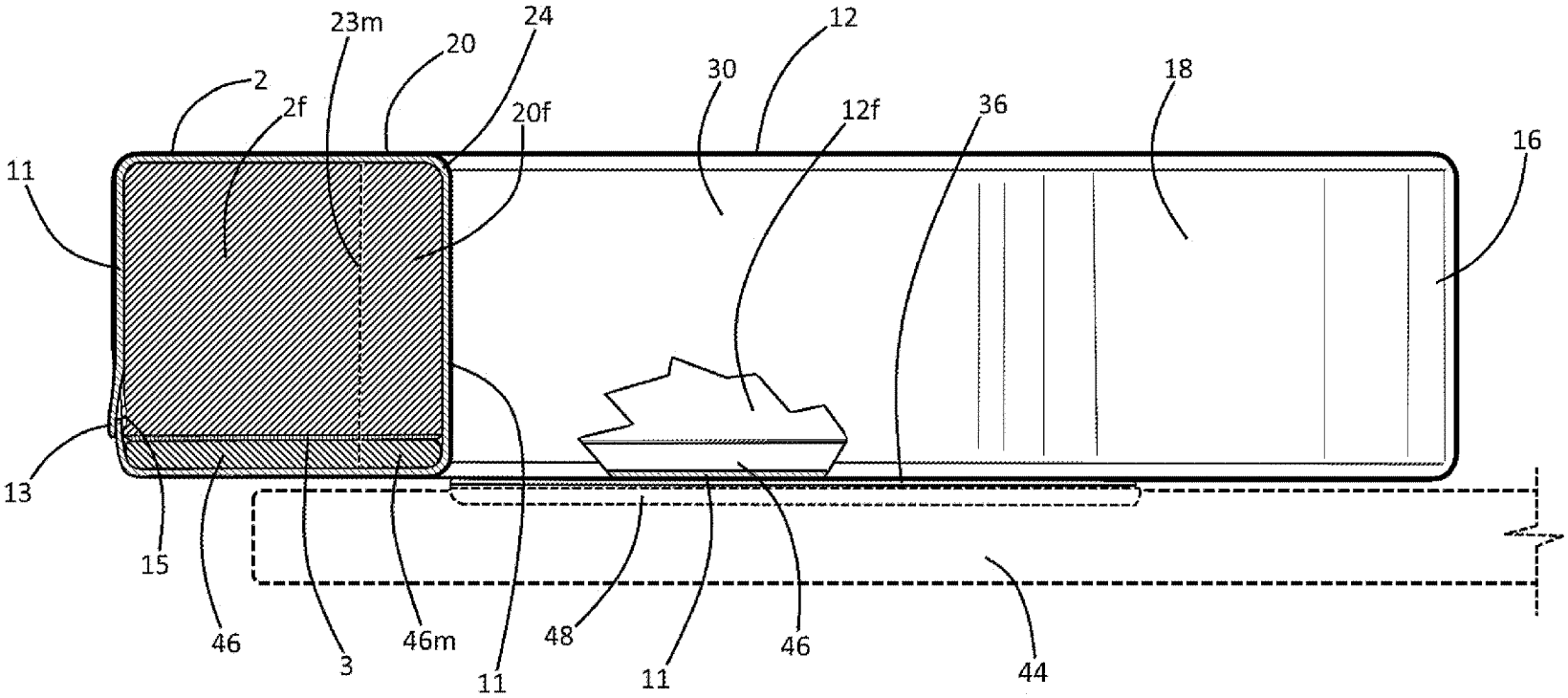
FIG. 4 is a sectional view as indicated in FIG. 1.

The distal displacement of or extension of the glabellar contacting medial arm end 24 from its column/arm junction 23*m* is preferably 1¼ inches, such length allowing, referring to FIGS. 3 and 4, the upper and distal aspect of arm 20 to upwardly press against the facial glabellar point 52 of the face of a commonly sized patient or subject 50. Suitably, the distal extension of the medial arm 20 may alternatively be as short as ½ inch or as long as 1¾ inches. The patient or subject 50 is representative of prone positioned persons who are medically or chiropractically treated, examined or manipulated, prone positioned persons who receive physical therapy manipulations, and prone positioned persons who receive massage or acupressure therapy. Referring further to FIG. 1, cushioned table or bench 54 is representative of tables utilized for all types of treatments, examination, manipulation, and therapy which are performed upon a prone subject.

Referring simultaneously to FIGS. 1 and 2, the inner aspects of the distal ends of the left and right "E" cushion arms 4 and 12 preferably arcuately and convexly curve inwardly to form left and right cheek supports 10 and 18, the inner aspects or surfaces 9 and 17 of such supports forming and defining therebetween a chin clearance channel 32.

As a result of enhanced medial facial support provided by the medial arm 20, the width of the cushion's central opening 30 may be increased beyond the user's eye spacing, as indicated in FIG. 3. Such opening width enhancement advantageously avoids exertions of pressure by the "E" cushion against the user's facial sinuses.

Referring simultaneously to FIGS. 1, 2, and 4, the interior matrices of the "E" cushion 2,4,12 are preferably composed of elastomeric foam or other common cushioning material, such matrices being denoted by the reference numerals in FIG. 4 having the suffix "f". Flexible foam interior 2*f* forms the "E" cushion's column section 2, foam interior 12*f* forms the "E" cushion's right arm 12, and foam interior 20*f* forms the medial arm 20. The lateral and vertical dashed line 23*m* of Drawing FIG. 4 is co-planar with FIG. 2's line 23*m*, such lines representing the juncture of the "E" cushion's column 2 and medial arm 20.

A rigid base or support plate 46 is provided for underlying support of the "E" cushion, such base 46 preferably having a medial extension 46*m* which directly underlies and supports the cushion's medial arm 20. The cushioning foam rubber portions of the "E" cushion are preferably fixedly bonded to the upper surface of the rigid base 46 by adhesive bond 3.

Referring to FIGS. 1, 2, and 4, a vinyl or fabric cover 11 is preferably disposed over structures including the "E" cushion 2,4,12 and the rigid base 46, such components being slidably insertable into the cover 11 by means of an insertion seam 13 which is closed by a peripherally extending zipper 15. Cover 11 is intended as representative of flexible plastic coatings which may be directly applied to the cushion's elastomeric foam substrate.

Referring simultaneously to FIGS. 1 and 3, tables or benches such as examination/therapy table 54 are commonly equipped with left and right face cradle supporting brackets or arms 38 and 44, such arms being connected to socket mounted extension arms 40 by means of position angle adjusting joints 42. To facilitate utilization of such arms 38 and 44, the facial cradle 1 preferably comprises support arm mounting means which is capable of alternatively securely attaching the cradle to arms 38 and 44, and enabling removal therefrom. In a preferred embodiment, the support arm mounting means comprise flexible hook and loop pad (commonly "velcro" fasteners) combinations 34,36,48. Such fasteners' flexible hook pads 34 and 36 may be fixedly attached to the undersurface of the "E" cushion or plate 46, while loop pads 48 are correspondingly fixedly attached to upper surfaces of the arms 38 and 44. The depicted support arm mounting means 34,36,48 are representative of other commonly known removable mounting means such as snap fasteners, adhesive bonds, nut and bolt fasteners, screw fasteners, snap ridge and snap channel fasteners, and slide ridge and slide channel fasteners.

In use of the instant invention, referring to FIGS. 1 and 3, a patient or subject 50 may lie prone upon table 54 and may place her face in the position indicated. Upon such facial positioning, the subject 50 may view downwardly through space 30 while her forehead is supported by column section 2 and while her left and right facial cheeks are comfortably supported by cheek supports 10 and 18. The chin clearance channel 32 formed between such supports allows for comfortable extension and positioning of the subject's chin. Simultaneously with the invention's provision of such facial support, the distal end or posterior vertex 24 of the "E" cushion's medial arm 20 advantageously presses upwardly against the subject's glabellar acupressure point 52. Mechanical contact and pressure exerted by arm 20 against the glabellar point 52 beneficially functions in the manner of acupressure therapy to reduce anxiety and to induce a state of calm.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope at least commensurate with the appended claims.

The invention hereby claimed is:

1. A cradle for upwardly contacting a prone patient's face and for supporting said patient's head, said patient's head having eyes, and said patient's forehead having a facial glabellar point, said cradle comprising:

(a) an "E" cushion having a column portion having upper and lower sides, wherein the column portion's upper side has an upper elevation, the "E" cushion comprising a left arm, a right arm, and a medial arm, each arm among the left, right, and medial arms having a proximal end attached to the column portion and having a distal end, wherein the distal end of the medial arm has an upper side having an upper elevation substantially equal to that of the column portion's upper side, wherein the upper elevations adapt the medial arm for, upon a use of the cradle to upwardly support the prone patient's face, impinging the medial arm against said patient's facial glabellar point without blocking adjacent regions underlying the patient's eyes, wherein the medial arm has a "V" configuration having a vertex, a left wall associated with the left arm and a left cheek support, and a right wall associated with the right arm and a right cheek support, the vertex of the "V" being positioned at the distal end of the medial arm with each wall of the "V" extending opposite the other wall contiguously into a concave curve along a length of the arm with which it is associated and transitioning to a convex curve along a length of the cheek support with which it is associated;

(b) a rigid base fixedly attached to the "E" cushion's lower side; and (c) support arm mounting means fixedly attached to the rigid base.

2. The cradle of claim 1 wherein the left and right cheek supports have inner ends and respectively extend rightwardly and leftwardly from the "E" cushion's left and right arms.

3. The cradle of claim 2 further comprising a chin clearance channel having left and right walls, said walls respectively comprising the left and right cheek supports' inner ends.

4. The cradle of claim 3 wherein the rigid base has a medial extension, the medial extension underlying the "E" cushion's medial arm.

5. The cradle of claim 4 wherein each wall among the left and right walls is positioned at an angle with respect to the other wall between 75° and 105°.

6. The cradle of claim 4 wherein the medial arm has a length between ½ inch and 1¾ inches.

7. The cradle of claim 6 wherein the support arm mounting means comprise left and right flexible hook and loop pad combinations.

* * * * *